US011898356B2

(12) United States Patent
Boo

(10) Patent No.: US 11,898,356 B2
(45) **Date of Patent: *Feb. 13, 2024**

(54) FLOORBOARDS PROVIDED WITH A MECHANICAL LOCKING SYSTEM

(71) Applicant: Välinge Innovation AB, Viken (SE)

(72) Inventor: Christian Boo, Kågeröd (SE)

(73) Assignee: Välinge Innovation AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 17/865,772

(22) Filed: Jul. 15, 2022

(65) Prior Publication Data

US 2023/0115427 A1 Apr. 13, 2023

Related U.S. Application Data

(63) Continuation of application No. 17/067,989, filed on Oct. 12, 2020, now Pat. No. 11,421,426, which is a (Continued)

(30) Foreign Application Priority Data

Mar. 25, 2013 (SE) ..... 1350377-6

(51) Int. Cl.
*E04F 15/02* (2006.01)
*E04F 15/10* (2006.01)

(52) U.S. Cl.
CPC ..... *E04F 15/02038* (2013.01); *E04F 15/107* (2013.01); *E04F 2201/0146* (2013.01); (Continued)

(58) Field of Classification Search
None
See application file for complete search history.

(56) References Cited

U.S. PATENT DOCUMENTS 213,740 A 4/1879 Conner
1,394,120 A 10/1921 Rockwell
(Continued)

FOREIGN PATENT DOCUMENTS

CA 2252791 A1 5/1999
CN 2076142 U 5/1991
(Continued)

OTHER PUBLICATIONS

Communication Pursuant to Article 94(3) EPC dated Oct. 13, 2017 in EP Patent Application No. 14 794 996.0, EPO, Munich, DE, 9 pages.

(Continued)

*Primary Examiner* — Kyle J. Walraed-Sullivan
(74) *Attorney, Agent, or Firm* — Boone IP Law

(57) ABSTRACT

Floorboards provided with a mechanical locking system including a locking strip protruding from a first edge of a first floorboard. The locking strip is provided with a locking element configured to cooperate with a locking groove at a lower side of a second edge of a second floorboard for locking the first edge and the second edge in a horizontal direction. The first edge and the second edge are configured to be assembled by a vertical downward motion of the second edge towards the first edge. The second edge is provided with a calibrating groove adjacent the locking groove. Also, a method for producing a mechanical locking system.

20 Claims, 4 Drawing Sheets

Related U.S. Application Data continuation of application No. 16/528,992, filed on Aug. 1, 2019, now Pat. No. 10,844,612, which is a continuation of application No. 15/333,630, filed on Oct. 25, 2016, now Pat. No. 10,407,919, which is a continuation of application No. 14/224,628, filed on Mar. 25, 2014, now Pat. No. 10,301,830.

(52) U.S. Cl.
CPC ..... *E04F 2201/042* (2013.01); *E04F 2201/0547* (2013.01); *E04F 2203/08* (2013.01)

(56) References Cited

U.S. PATENT DOCUMENTS 1,787,027 A 12/1930 Wasleff
1,925,070 A 8/1933 Livezey
2,015,813 A 10/1935 Nielsen
2,088,238 A 7/1937 Ray
2,089,075 A 8/1937 Siebs
2,266,464 A 12/1941 Kraft
2,303,745 A 12/1942 Karreman
2,306,295 A 12/1942 Casto
2,497,837 A 2/1950 Nelson
2,740,167 A 4/1956 Rowley
2,769,726 A 11/1956 Wetterau et al.
2,818,895 A 1/1958 Zuber
2,872,712 A 2/1959 Brown et al.
2,947,040 A 8/1960 Schultz
3,051,084 A 8/1962 Scheibli
3,055,461 A 9/1962 De Ridder
3,087,269 A 4/1963 Hudson
3,120,083 A 2/1964 Dahlberg et al.
3,247,638 A 4/1966 Gay, Jr.
3,259,417 A 7/1966 Chapman
3,397,496 A 8/1968 Sohns
3,436,888 A 4/1969 Par
3,538,665 A 11/1970 Gohner
3,554,850 A 1/1971 Kuhle
3,578,548 A 5/1971 Wesp
3,694,983 A 10/1972 Couquet
3,720,027 A 3/1973 Christensen
3,742,669 A 7/1973 Mansfeld
3,760,547 A 9/1973 Brenneman
3,857,749 A 12/1974 Yoshida
3,919,820 A 11/1975 Green
3,937,861 A 2/1976 Zuckerman et al.
4,037,377 A 7/1977 Howell et al.
4,100,710 A 7/1978 Kowallik
4,113,399 A 9/1978 Hansen, Sr.
4,172,169 A 10/1979 Mawson et al.
4,176,210 A 11/1979 Skinner
4,180,615 A 12/1979 Bettoli
4,187,131 A 2/1980 Graham et al.
4,196,554 A 4/1980 Anderson et al.
4,242,390 A 12/1980 Nemeth
4,299,070 A 11/1981 Oltmanns et al.
4,313,866 A 2/1982 Renshaw
4,333,987 A 6/1982 Kwart et al.
4,393,187 A 7/1983 Boba et al.
4,423,178 A 12/1983 Renshaw
4,426,820 A 1/1984 Terbrack et al.
4,489,115 A 12/1984 Layman et al.
4,507,188 A 3/1985 Chu
4,512,131 A 4/1985 Laramore
4,570,353 A 2/1986 Evans et al.
4,574,099 A 3/1986 Nixon
4,599,841 A 7/1986 Haid
4,614,680 A 9/1986 Fry et al.
4,772,500 A 9/1988 Stroppiana
4,785,065 A 11/1988 Uhl et al.
4,807,412 A 2/1989 Frederiksen
4,944,514 A 7/1990 Suiter
5,007,222 A 4/1991 Raymond
5,050,362 A 9/1991 Tal et al.
5,112,671 A 5/1992 Diamond et al.
5,134,026 A 7/1992 Melcher
5,148,850 A 9/1992 Urbanick
5,162,141 A 11/1992 Pavey et al.
5,182,892 A 2/1993 Chase
5,185,193 A 2/1993 Phenicie et al.
5,229,217 A 7/1993 Holzer
5,295,341 A 3/1994 Kajiwara
5,333,429 A 8/1994 Cretti
5,344,700 A 9/1994 McGath et al.
5,349,796 A 9/1994 Meyerson
5,380,794 A 1/1995 Schaefer et al.
5,433,806 A 7/1995 Pasquali et al.
5,441,677 A 8/1995 Phillips, Sr.
5,458,953 A 10/1995 Wang et al.
5,465,546 A 11/1995 Buse
5,502,939 A 4/1996 Zadok et al.
5,548,937 A 8/1996 Shimonohara
5,618,602 A 4/1997 Nelson
5,630,304 A 5/1997 Austin
5,670,237 A 9/1997 Shultz et al.
5,671,575 A 9/1997 Wu
5,694,730 A 12/1997 Del et al.
5,706,621 A 1/1998 Pervan
5,755,068 A 5/1998 Ormiston
5,797,237 A 8/1998 Finkell, Jr.
5,858,160 A 1/1999 Piacente et al.
5,900,099 A 5/1999 Sweet et al.
5,950,389 A 9/1999 Porter
6,006,486 A 12/1999 Moriau et al.
6,029,416 A 2/2000 Andersson
6,052,960 A 4/2000 Yonemura
6,065,262 A 5/2000 Motta
6,101,778 A 8/2000 Goeran
6,139,945 A 10/2000 Krejchi et al.
6,173,548 B1 1/2001 Hamar et al.
6,182,410 B1 2/2001 Pervan
6,209,278 B1 4/2001 Tychsen
6,216,409 B1 4/2001 Roy et al.
6,233,899 B1 5/2001 Mellert et al.
6,291,078 B1 9/2001 Chen et al.
6,314,701 B1 11/2001 Meyerson
6,324,809 B1 12/2001 Nelson
6,332,733 B1 12/2001 Hamberger et al.
6,345,481 B1 2/2002 Nelson
6,363,677 B1 4/2002 Chen et al.
6,397,547 B1 6/2002 Martensson
6,438,919 B1 8/2002 Knauseder
6,455,127 B1 9/2002 Valtanen
6,490,836 B1 12/2002 Moriau et al.
6,505,452 B1 1/2003 Hannig et al.
6,536,178 B1 3/2003 Paalsson et al.
6,546,691 B2 4/2003 Leopolder
6,553,724 B1 4/2003 Bigler
6,558,070 B1 5/2003 Valtanen
6,591,568 B1 7/2003 Paalsson
6,617,009 B1 9/2003 Chen et al.
6,647,690 B1 11/2003 Martensson
6,671,968 B2 1/2004 Shannon
6,672,030 B2 1/2004 Schulte
6,675,545 B2 1/2004 Chen et al.
6,695,944 B2 2/2004 Courtney
6,711,869 B2 3/2004 Tychsen
6,715,253 B2 4/2004 Pervan
6,729,091 B1 5/2004 Martensson
6,761,008 B2 7/2004 Chen et al.
6,763,643 B1 7/2004 Maartensson
6,766,622 B1 7/2004 Thiers
6,769,218 B2 8/2004 Pervan
6,769,219 B2 8/2004 Schwitte et al.
6,772,568 B2 8/2004 Thiers et al.
6,786,019 B2 9/2004 Thiers
6,790,512 B2 9/2004 MacQueen et al.
6,804,926 B1 10/2004 Eisermann
6,851,237 B2 2/2005 Niese et al.
6,851,241 B2 2/2005 Pervan
6,854,235 B2 2/2005 Martensson
6,862,857 B2 3/2005 Tychsen
6,865,855 B2 3/2005 Knauseder

(56) References Cited

U.S. PATENT DOCUMENTS

| | | | |
|---|---|---|---|
| 6,874,292 | B2 | 4/2005 | Moriau et al. |
| 6,880,305 | B2 | 4/2005 | Pervan et al. |
| 6,880,307 | B2 | 4/2005 | Schwitte et al. |
| 6,895,881 | B1 | 5/2005 | Whitaker |
| 6,898,911 | B2 | 5/2005 | Kornfalt et al. |
| 6,898,913 | B2 | 5/2005 | Pervan |
| 6,918,220 | B2 | 7/2005 | Pervan |
| 6,922,964 | B2 | 8/2005 | Pervan |
| 6,922,965 | B2 | 8/2005 | Rosenthal et al. |
| 6,928,779 | B2 | 8/2005 | Moriau et al. |
| 6,933,043 | B1 | 8/2005 | Son et al. |
| 6,955,020 | B2 | 10/2005 | Moriau et al. |
| 6,966,963 | B2 | 11/2005 | O'Connor |
| 6,986,934 | B2 | 1/2006 | Chen et al. |
| 7,051,486 | B2 | 5/2006 | Pervan |
| 7,086,205 | B2 | 8/2006 | Pervan |
| 7,090,430 | B1 | 8/2006 | Fletcher et al. |
| D528,671 | S | 9/2006 | Grafenauer |
| 7,121,058 | B2 | 10/2006 | Palsson et al. |
| 7,127,860 | B2 | 10/2006 | Pervan et al. |
| 7,137,229 | B2 | 11/2006 | Pervan |
| 7,155,871 | B1 | 1/2007 | Stone et al. |
| 7,169,460 | B1 | 1/2007 | Chen et al. |
| 7,171,791 | B2 | 2/2007 | Pervan |
| 7,211,310 | B2 | 5/2007 | Chen et al. |
| 7,251,916 | B2 | 8/2007 | Konzelmann et al. |
| 7,275,350 | B2 | 10/2007 | Pervan et al. |
| 7,328,536 | B2 | 2/2008 | Moriau et al. |
| 7,337,588 | B1 | 3/2008 | Moebus |
| 7,356,971 | B2 | 4/2008 | Pervan |
| 7,377,081 | B2 | 5/2008 | Ruhdorfer |
| 7,386,963 | B2 | 6/2008 | Pervan |
| 7,398,625 | B2 | 7/2008 | Pervan |
| 7,419,717 | B2 | 9/2008 | Chen et al. |
| 7,451,578 | B2 | 11/2008 | Hannig |
| 7,454,875 | B2 | 11/2008 | Pervan et al. |
| 7,484,337 | B2 | 2/2009 | Hecht |
| 7,516,588 | B2 | 4/2009 | Pervan |
| 7,543,418 | B2 | 6/2009 | Weitzer |
| 7,552,568 | B2 | 6/2009 | Paalsson et al. |
| 7,568,322 | B2 | 8/2009 | Pervan |
| 7,584,583 | B2 | 9/2009 | Bergelin et al. |
| 7,603,826 | B1 | 10/2009 | Moebus |
| 7,607,271 | B2 | 10/2009 | Griffin et al. |
| 7,614,197 | B2 | 11/2009 | Nelson |
| 7,617,645 | B2 | 11/2009 | Moriau et al. |
| 7,621,094 | B2 | 11/2009 | Moriau et al. |
| 7,634,886 | B2 | 12/2009 | Moriau et al. |
| 7,634,887 | B2 | 12/2009 | Moriau et al. |
| 7,637,066 | B2 | 12/2009 | Moriau et al. |
| 7,640,708 | B2 | 1/2010 | Moriau et al. |
| 7,644,555 | B2 | 1/2010 | Moriau et al. |
| 7,644,557 | B2 | 1/2010 | Moriau et al. |
| 7,647,743 | B2 | 1/2010 | Moriau et al. |
| 7,650,728 | B2 | 1/2010 | Moriau et al. |
| 7,654,054 | B2 | 2/2010 | Moriau et al. |
| 7,658,048 | B2 | 2/2010 | Moriau et al. |
| 7,677,001 | B2 | 3/2010 | Pervan |
| 7,678,215 | B2 | 3/2010 | Martin et al. |
| 7,716,896 | B2 | 5/2010 | Pervan |
| 7,739,849 | B2 | 6/2010 | Pervan |
| 7,763,345 | B2 | 7/2010 | Chen et al. |
| 7,779,597 | B2 | 8/2010 | Thiers et al. |
| 7,802,415 | B2 | 9/2010 | Pervan et al. |
| 7,841,144 | B2 | 11/2010 | Pervan |
| 7,841,150 | B2 | 11/2010 | Pervan |
| 7,856,784 | B2 | 12/2010 | Martensson |
| 7,856,789 | B2 | 12/2010 | Eisermann |
| 7,861,482 | B2 | 1/2011 | Pervan et al. |
| 7,866,110 | B2 | 1/2011 | Pervan |
| 7,866,115 | B2 | 1/2011 | Pervan et al. |
| 7,886,497 | B2 | 2/2011 | Pervan |
| 7,896,571 | B1 | 3/2011 | Hannig et al. |
| 7,926,234 | B2 | 4/2011 | Pervan et al. |
| 7,930,862 | B2 | 4/2011 | Bergelin et al. |
| 7,958,689 | B2 | 6/2011 | Lei |
| 7,980,043 | B2 | 7/2011 | Moebus |
| 7,984,600 | B2 | 7/2011 | Alford et al. |
| 8,006,460 | B2 | 8/2011 | Chen et al. |
| 8,021,741 | B2 | 9/2011 | Chen et al. |
| 8,028,486 | B2 | 10/2011 | Pervan et al. |
| 8,037,656 | B2 | 10/2011 | Liu et al. |
| 8,038,363 | B2 | 10/2011 | Hannig et al. |
| 8,042,311 | B2 | 10/2011 | Pervan et al. |
| 8,071,193 | B2 | 12/2011 | Windmoeller |
| 8,091,238 | B2 | 1/2012 | Hannig |
| 8,099,924 | B2 | 1/2012 | Braun |
| 8,112,891 | B2 | 2/2012 | Pervan |
| 8,132,384 | B2 | 3/2012 | Hannig |
| 8,166,718 | B2 | 5/2012 | Liu |
| 8,191,333 | B2 | 6/2012 | Braun |
| 8,196,366 | B2 | 6/2012 | Thiers et al. |
| 8,215,078 | B2 | 7/2012 | Pervan |
| 8,234,829 | B2 | 8/2012 | Thiers et al. |
| 8,245,478 | B2 | 8/2012 | Bergelin et al. |
| 8,281,549 | B2 | 10/2012 | Du |
| 8,293,058 | B2 | 10/2012 | Pervan et al. |
| 8,353,140 | B2 | 1/2013 | Pervan et al. |
| 8,356,452 | B2 | 1/2013 | Thiers et al. |
| 8,365,499 | B2 | 2/2013 | Nilsson et al. |
| 8,375,672 | B2 | 2/2013 | Hannig |
| 8,375,674 | B2 | 2/2013 | Braun et al. |
| 8,480,841 | B2 | 7/2013 | Pervan et al. |
| 8,484,924 | B2 | 7/2013 | Braun |
| 8,490,361 | B2 | 7/2013 | Curry et al. |
| 8,499,521 | B2 | 8/2013 | Pervan et al. |
| 8,511,031 | B2 | 8/2013 | Bergelin et al. |
| 8,544,231 | B2 | 10/2013 | Hannig |
| 8,544,232 | B2 | 10/2013 | Wybo et al. |
| 8,544,234 | B2 | 10/2013 | Pervan et al. |
| 8,584,423 | B2 | 11/2013 | Pervan et al. |
| 8,613,826 | B2 | 12/2013 | Pervan et al. |
| 8,658,274 | B2 | 2/2014 | Chen et al. |
| 8,683,698 | B2 | 4/2014 | Pervan et al. |
| 8,707,651 | B2 | 4/2014 | Stockl |
| 8,720,149 | B2 | 5/2014 | Bossuyt |
| 8,726,604 | B2 | 5/2014 | Hannig |
| 8,745,952 | B2 | 6/2014 | Perra et al. |
| 8,756,899 | B2 | 6/2014 | Nilsson et al. |
| 8,763,340 | B2 | 7/2014 | Pervan et al. |
| 8,800,150 | B2 | 8/2014 | Pervan |
| 8,806,832 | B2 | 8/2014 | Kell |
| 8,833,028 | B2 | 9/2014 | Whispell et al. |
| 8,834,992 | B2 | 9/2014 | Chen et al. |
| 8,952,078 | B2 | 2/2015 | Gould |
| 8,966,853 | B2 | 3/2015 | Hannig |
| 8,978,336 | B2 | 3/2015 | Perra et al. |
| 9,103,126 | B2 | 8/2015 | Kell |
| 9,212,492 | B2 | 12/2015 | Pervan et al. |
| 9,217,250 | B2 | 12/2015 | Perra et al. |
| 9,222,267 | B2 | 12/2015 | Bergelin et al. |
| 9,228,360 | B2 | 1/2016 | Schneider |
| 9,260,870 | B2 | 2/2016 | Vermeulen et al. |
| 9,296,191 | B2 | 3/2016 | Pervan et al. |
| 9,314,936 | B2 | 4/2016 | Pervan |
| 9,371,653 | B2 | 6/2016 | Liu |
| 9,528,278 | B2 | 12/2016 | Cappelle |
| 9,650,792 | B2 | 5/2017 | Ramachandra |
| 9,695,600 | B2 | 7/2017 | Vandevoorde et al. |
| 9,695,601 | B2 | 7/2017 | Whispell et al. |
| 9,695,851 | B2 | 7/2017 | Hannig |
| 9,745,758 | B2 | 8/2017 | Baert et al. |
| 9,765,530 | B2 | 9/2017 | Bergelin et al. |
| 9,777,487 | B2 | 10/2017 | Pervan et al. |
| 9,803,374 | B2 | 10/2017 | Pervan |
| 9,816,270 | B2 | 11/2017 | Pervan et al. |
| 9,874,035 | B2 | 1/2018 | Wagner |
| 9,885,186 | B2 | 2/2018 | Liu |
| 9,885,187 | B2 | 2/2018 | Kell |
| 10,000,935 | B2 | 6/2018 | Kell |
| 10,059,084 | B2 | 8/2018 | Lundblad et al. |
| 10,113,318 | B2 | 10/2018 | Cappelle et al. |
| 10,137,659 | B2 | 11/2018 | Pervan |
| 10,214,917 | B2 | 2/2019 | Pervan et al. |

(56) References Cited

U.S. PATENT DOCUMENTS 10,301,830 B2 5/2019 Boo
10,344,379 B2 7/2019 Pervan et al.
10,450,760 B2 10/2019 Bergelin et al.
10,486,399 B2 11/2019 Chen et al.
10,493,731 B2 12/2019 Lundblad et al.
10,780,676 B2 9/2020 Lundblad et al.
10,844,612 B2 11/2020 Boo
10,975,580 B2 4/2021 Pervan et al.
11,066,836 B2 7/2021 Bergelin et al.
2001/0021431 A1 9/2001 Chen et al.
2002/0007606 A1* 1/2002 Kettler ..... E04F 15/04 52/390
2002/0007608 A1 1/2002 Pervan
2002/0007609 A1* 1/2002 Pervan ..... E04F 15/02 52/592.2
2002/0023702 A1 2/2002 Kettler
2002/0031646 A1 3/2002 Chen et al.
2002/0046433 A1 4/2002 Sellman et al.
2002/0056245 A1 5/2002 Thiers
2002/0069611 A1* 6/2002 Leopolder ..... E04F 15/02 52/590.3
2002/0083673 A1 7/2002 Kettler et al.
2002/0092263 A1 7/2002 Schulte
2002/0095894 A1 7/2002 Pervan
2002/0100231 A1 8/2002 Miller et al.
2002/0112429 A1 8/2002 Niese et al.
2002/0112433 A1 8/2002 Pervan
2002/0142135 A1 10/2002 Chen et al.
2002/0152707 A1 10/2002 Martensson
2002/0170257 A1 11/2002 McLain et al.
2002/0170258 A1* 11/2002 Schwitte ..... E04F 15/02 52/592.1
2002/0178674 A1 12/2002 Pervan
2002/0178681 A1 12/2002 Zancai et al.
2002/0189183 A1 12/2002 Ricciardelli
2003/0009971 A1 1/2003 Palmberg
2003/0024199 A1* 2/2003 Pervan ..... E04F 15/02011 52/592.1
2003/0024200 A1 2/2003 Moriau et al.
2003/0033777 A1 2/2003 Thiers et al.
2003/0037504 A1 2/2003 Schwitte et al.
2003/0041545 A1 3/2003 Stanchfield
2003/0101674 A1* 6/2003 Pervan ..... E04C 2/20 52/592.1
2003/0101681 A1 6/2003 Tychsen
2003/0110720 A1 6/2003 Berard et al.
2003/0140478 A1 7/2003 Olofsson
2003/0154676 A1 8/2003 Schwartz
2003/0180091 A1 9/2003 Stridsman
2003/0188504 A1 10/2003 Ralf
2003/0196397 A1 10/2003 Niese et al.
2003/0196405 A1 10/2003 Pervan
2003/0224147 A1 12/2003 Maine et al.
2004/0031225 A1* 2/2004 Fowler ..... E04F 15/02 52/592.1
2004/0031227 A1 2/2004 Knauseder
2004/0035078 A1 2/2004 Pervan
2004/0060255 A1 4/2004 Knauseder
2004/0068954 A1 4/2004 Martensson
2004/0107659 A1 6/2004 Glockl
2004/0128934 A1 7/2004 Hecht
2004/0137180 A1* 7/2004 Sjoberg ..... E04F 15/02016 428/192
2004/0139678 A1 7/2004 Pervan
2004/0168392 A1 9/2004 Konzelmann et al.
2004/0177584 A1* 9/2004 Pervan ..... B32B 21/10 52/592.1
2004/0182036 A1* 9/2004 Sjoberg ..... E04F 15/02016 52/592.1
2004/0206036 A1* 10/2004 Pervan ..... E04F 15/041 52/578
2004/0211143 A1 10/2004 Hanning
2004/0211144 A1 10/2004 Stanchfield
2004/0219339 A1 11/2004 Dempsey et al.
2004/0241374 A1 12/2004 Thiers et al.
2004/0255538 A1 12/2004 Ruhdorfer
2004/0255541 A1* 12/2004 Thiers ..... E04F 15/02011 52/506.01
2004/0261348 A1 12/2004 Vulin
2005/0003160 A1 1/2005 Chen et al.
2005/0028474 A1 2/2005 Kim
2005/0055943 A1 3/2005 Pervan
2005/0112320 A1 5/2005 Wright
2005/0138881 A1* 6/2005 Pervan ..... E04F 15/02 52/581
2005/0144881 A1* 7/2005 Tate ..... E04F 15/10 52/578
2005/0166502 A1 8/2005 Pervan et al.
2005/0166514 A1 8/2005 Pervan
2005/0166516 A1 8/2005 Pervan
2005/0176321 A1 8/2005 Crette et al.
2005/0193677 A1 9/2005 Vogel
2005/0208255 A1 9/2005 Pervan
2005/0210810 A1* 9/2005 Pervan ..... E04F 15/02038 52/578
2005/0221073 A1 10/2005 Liou
2005/0235593 A1 10/2005 Hecht
2005/0247000 A1* 11/2005 Zhu ..... E04F 15/02 52/588.1
2005/0250921 A1 11/2005 Qiu et al.
2005/0252130 A1 11/2005 Martensson
2005/0268570 A2* 12/2005 Pervan ..... E04F 15/02038 52/578
2006/0010820 A1 1/2006 Schwitte et al.
2006/0032168 A1 2/2006 Thiers et al.
2006/0032175 A1 2/2006 Chen et al.
2006/0048474 A1 3/2006 Pervan et al.
2006/0053724 A1* 3/2006 Braun ..... C09J 5/00 52/578
2006/0070333 A1 4/2006 Pervan
2006/0075713 A1 4/2006 Pervan et al.
2006/0099386 A1 5/2006 Smith
2006/0101769 A1 5/2006 Pervan et al.
2006/0144004 A1 7/2006 Nollet et al.
2006/0154015 A1 7/2006 Miller et al.
2006/0156666 A1 7/2006 Caufield
2006/0174974 A1 8/2006 Brannstrom et al.
2006/0196139 A1 9/2006 Pervan et al.
2006/0225377 A1 10/2006 Moriau et al.
2006/0236642 A1* 10/2006 Pervan ..... E04F 15/02005 52/578
2006/0248830 A1 11/2006 Gustaaf et al.
2006/0248831 A1 11/2006 Moriau et al.
2006/0260252 A1 11/2006 Brice
2006/0260254 A1* 11/2006 Pervan ..... E04F 15/02 52/592.1
2006/0283127 A1 12/2006 Pervan
2007/0006543 A1 1/2007 Engstrom
2007/0011981 A1 1/2007 Eisermann
2007/0022694 A1 2/2007 Chen et al.
2007/0028547 A1 2/2007 Grafenauer et al.
2007/0094986 A1 5/2007 Moriau et al.
2007/0094987 A1 5/2007 Moriau et al.
2007/0130872 A1* 6/2007 Goodwin ..... E04F 15/02 52/592.1
2007/0151189 A1 7/2007 Yang
2007/0151191 A1 7/2007 August
2007/0154840 A1 7/2007 Thies et al.
2007/0166516 A1 7/2007 Kim et al.
2007/0175143 A1 8/2007 Pervan et al.
2007/0175144 A1 8/2007 Hakansson
2007/0175148 A1* 8/2007 Bergelin ..... E04F 15/02033 52/480
2007/0175156 A1 8/2007 Pervan et al.
2007/0184230 A1* 8/2007 Verrue ..... A47G 27/0293 428/60
2007/0193178 A1* 8/2007 Groeke ..... F16B 5/0056 52/578
2007/0196624 A1 8/2007 Chen et al.
2007/0218252 A1 9/2007 Donald
2007/0275207 A1 11/2007 Higgins et al.
2008/0000179 A1 1/2008 Pervan et al.

(56) References Cited

U.S. PATENT DOCUMENTS

2008/0000180 A1 1/2008 Pervan
2008/0000182 A1 1/2008 Pervan
2008/0000183 A1 1/2008 Bergelin et al.
2008/0000186 A1 1/2008 Pervan et al.
2008/0000187 A1 1/2008 Pervan
2008/0000188 A1 1/2008 Pervan
2008/0000189 A1 1/2008 Pervan et al.
2008/0000194 A1 1/2008 Pervan et al.
2008/0000417 A1 1/2008 Pervan et al.
2008/0005989 A1 1/2008 Pervan et al.
2008/0005992 A1 1/2008 Pervan
2008/0005997 A1 1/2008 Pervan
2008/0005998 A1 1/2008 Pervan
2008/0005999 A1 1/2008 Pervan
2008/0008871 A1 1/2008 Pervan
2008/0010931 A1 1/2008 Pervan et al.
2008/0010937 A1 1/2008 Pervan et al.
2008/0028707 A1 2/2008 Pervan
2008/0028713 A1* 2/2008 Pervan ..... E04F 15/02033 52/586.1
2008/0029490 A1 2/2008 Martin et al.
2008/0034701 A1* 2/2008 Pervan ..... B27N 7/00 52/309.3
2008/0034708 A1 2/2008 Pervan
2008/0041007 A1* 2/2008 Pervan ..... B44C 1/28 52/506.01
2008/0041008 A1 2/2008 Pervan
2008/0053028 A1 3/2008 Moriau et al.
2008/0060308 A1 3/2008 Pervan
2008/0060309 A1 3/2008 Moriau et al.
2008/0060310 A1 3/2008 Moriau et al.
2008/0066415 A1 3/2008 Pervan et al.
2008/0092473 A1* 4/2008 Heyns ..... E04F 15/087 52/592.2
2008/0104921 A1* 5/2008 Pervan ..... E04F 15/10 52/588.1
2008/0110125 A1 5/2008 Pervan
2008/0134607 A1 6/2008 Pervan et al.
2008/0134613 A1 6/2008 Pervan
2008/0134614 A1* 6/2008 Pervan ..... E04B 5/00 52/588.1
2008/0138560 A1 6/2008 Windmoller
2008/0141610 A1 6/2008 Thiers et al.
2008/0148674 A1 6/2008 Thiers et al.
2008/0153609 A1 6/2008 Kotler
2008/0172971 A1 7/2008 Pervan
2008/0184646 A1 8/2008 Alford et al.
2008/0241440 A1 10/2008 Bauer
2008/0256890 A1 10/2008 Pervan et al.
2008/0263975 A1 10/2008 Mead
2008/0311355 A1 12/2008 Chen et al.
2009/0031662 A1 2/2009 Chen et al.
2009/0038253 A1 2/2009 Martensson
2009/0049787 A1 2/2009 Hannig
2009/0110888 A1 4/2009 Wuest et al.
2009/0133353 A1* 5/2009 Pervan ..... H01F 7/122 52/747.1
2009/0151290 A1* 6/2009 Liu ..... E04F 15/04 52/592.1
2009/0155612 A1 6/2009 Pervan et al.
2009/0159156 A1 6/2009 Walker
2009/0186710 A1 7/2009 Joseph
2009/0193748 A1 8/2009 Boo et al.
2009/0217611 A1* 9/2009 Schrader ..... E04F 15/02005 52/394
2009/0223162 A1 9/2009 Chen et al.
2009/0226662 A1 9/2009 Dyczko-Riglin et al.
2009/0235604 A1 9/2009 Cheng et al.
2009/0249733 A1* 10/2009 Moebus ..... E04F 15/04 52/747.1
2009/0260313 A1* 10/2009 Segaert ..... B44C 5/043 52/592.1
2009/0272058 A1 11/2009 Duselis et al.
2009/0320402 A1* 12/2009 Schacht ..... E04F 15/041 52/745.05
2010/0011695 A1* 1/2010 Cheng ..... E04B 1/6179 52/592.1
2010/0018147 A1 1/2010 Du
2010/0018149 A1* 1/2010 Thiers ..... E04F 15/02 52/588.1
2010/0031594 A1 2/2010 Liu et al.
2010/0043333 A1* 2/2010 Hannig ..... F16B 5/0056 52/582.2
2010/0058702 A1* 3/2010 Lei ..... E04F 15/02 52/588.1
2010/0242398 A1 9/2010 Cullen
2010/0260962 A1 10/2010 Chen et al.
2010/0293879 A1* 11/2010 Pervan ..... E04F 15/02038 52/588.1
2010/0300029 A1* 12/2010 Braun ..... E04F 15/02 52/796.1
2010/0300030 A1 12/2010 Pervan et al.
2010/0319293 A1 12/2010 Dammers
2011/0001420 A1 1/2011 Tchakarov et al.
2011/0008567 A1 1/2011 Weeks et al.
2011/0030303 A1 2/2011 Pervan et al.
2011/0041996 A1 2/2011 Pervan
2011/0056167 A1* 3/2011 Nilsson ..... E04F 15/10 52/745.05
2011/0094178 A1 4/2011 Braun
2011/0131901 A1 6/2011 Pervan et al.
2011/0131909 A1* 6/2011 Hannig ..... E04F 15/02 52/309.1
2011/0138722 A1* 6/2011 Hannig ..... E04F 15/02033 52/309.1
2011/0146177 A1 6/2011 Hannig
2011/0154665 A1 6/2011 Pervan et al.
2011/0154763 A1 6/2011 Bergelin et al.
2011/0167744 A1 7/2011 Whispell et al.
2011/0173914 A1* 7/2011 Engstrom ..... E04F 15/02038 52/582.2
2011/0247285 A1 10/2011 Wybo et al.
2011/0247748 A1 10/2011 Pervan et al.
2011/0258959 A1 10/2011 Braun
2011/0296780 A1 12/2011 Ulrich
2012/0003439 A1 1/2012 Chen et al.
2012/0017534 A1* 1/2012 Oh ..... E04F 15/102 52/588.1
2012/0040149 A1 2/2012 Chen et al.
2012/0066996 A1* 3/2012 Konstanczak ..... E04F 13/08 52/588.1
2012/0067461 A1 3/2012 Braun
2012/0124932 A1 5/2012 Schulte et al.
2012/0137617 A1 6/2012 Pervan
2012/0174519 A1 7/2012 Schulte
2012/0174521 A1* 7/2012 Schulte ..... E04F 15/02 29/428
2012/0180416 A1 7/2012 Perra et al.
2012/0192521 A1* 8/2012 Schulte ..... E04F 13/08 52/588.1
2012/0216472 A1 8/2012 Martensson et al.
2012/0266555 A1* 10/2012 Cappelle ..... E04F 15/02038 52/309.1
2012/0276369 A1 11/2012 Jing et al.
2012/0279154 A1 11/2012 Bergelin et al.
2012/0304581 A1 12/2012 Kim
2013/0008118 A1 1/2013 Baert et al.
2013/0014890 A1 1/2013 Pervan et al.
2013/0025964 A1 1/2013 Ramachandra et al.
2013/0042563 A1* 2/2013 Pervan ..... E04F 15/02038 52/582.2
2013/0042565 A1 2/2013 Pervan et al.
2013/0047536 A1* 2/2013 Pervan ..... E04F 15/107 52/309.1
2013/0097959 A1* 4/2013 Michel ..... E04C 2/30 29/557
2013/0111758 A1 5/2013 Nilsson et al.
2013/0152492 A1 6/2013 Whitaker
2013/0160391 A1 6/2013 Pervan et al.
2013/0174507 A1 7/2013 Oehrlein

(56) References Cited

U.S. PATENT DOCUMENTS

2013/0180193 A1 7/2013 Bossuyt
2013/0212971 A1 8/2013 Cordeiro
2013/0243996 A1 9/2013 Hannig
2013/0269863 A1 10/2013 Pervan et al.
2013/0283719 A1 10/2013 Doehring et al.
2013/0298487 A1 11/2013 Bergelin et al.
2013/0305649 A1 11/2013 Thiers
2013/0305650 A1 11/2013 Liu
2013/0309441 A1* 11/2013 Hannig ..... E04F 15/102 29/428
2013/0333182 A1* 12/2013 Pervan ..... B27M 3/04 29/426.3
2014/0007539 A1 1/2014 Pervan et al.
2014/0033633 A1 2/2014 Kell
2014/0033635 A1 2/2014 Pervan et al.
2014/0069043 A1* 3/2014 Pervan ..... E04F 15/02 52/582.2
2014/0069044 A1* 3/2014 Wallin ..... E04F 15/041 52/588.1
2014/0115994 A1 5/2014 Pervan et al.
2014/0186104 A1* 7/2014 Hamberger ..... F16B 5/0016 403/292
2014/0215946 A1 8/2014 Roy et al.
2014/0237924 A1 8/2014 Nilsson et al.
2014/0283466 A1* 9/2014 Boo ..... E04F 15/02038 52/309.1
2014/0283477 A1 9/2014 Hannig
2014/0290173 A1 10/2014 Hamberger
2014/0318061 A1 10/2014 Pervan
2014/0325930 A1* 11/2014 Schneider ..... E04F 15/02038 52/588.1
2014/0352248 A1 12/2014 Whispell et al.
2014/0356594 A1 12/2014 Chen et al.
2014/0366476 A1 12/2014 Pervan et al.
2014/0366477 A1 12/2014 Kell
2015/0114552 A1 4/2015 Cernohous et al.
2015/0225964 A1 8/2015 Chen et al.
2015/0252573 A1 9/2015 Devos
2015/0330088 A1* 11/2015 Derelov ..... E04F 15/02038 52/588.1
2015/0368910 A1 12/2015 Kell
2016/0016390 A1 1/2016 Lundblad et al.
2016/0016391 A1 1/2016 Lundblad et al.
2016/0047129 A1 2/2016 Bowers
2016/0052245 A1 2/2016 Chen et al.
2016/0069089 A1 3/2016 Bergelin et al.
2016/0076260 A1 3/2016 Pervan et al.
2016/0108624 A1 4/2016 Nilsson et al.
2016/0115695 A1* 4/2016 Devos ..... E04F 15/02038 52/582.2
2016/0138274 A1* 5/2016 Anspach ..... E04F 15/105 52/177
2016/0186318 A1 6/2016 Pervan et al.
2016/0194883 A1 7/2016 Pervan
2016/0194885 A1 7/2016 Whispell et al.
2016/0201324 A1 7/2016 Hkansson et al.
2016/0265234 A1 9/2016 Pervan
2016/0333595 A1 11/2016 Cappelle et al.
2016/0375674 A1* 12/2016 Schulte ..... E04F 15/045 156/220
2017/0030088 A1 2/2017 Simoens
2017/0037642 A1 2/2017 Boo
2017/0037645 A1 2/2017 Pervan
2017/0175400 A1* 6/2017 Josefsson ..... E04F 15/02038
2017/0241136 A1 8/2017 Kell
2017/0350140 A1 12/2017 Bergelin et al.
2017/0362834 A1 12/2017 Pervan et al.
2017/0370109 A1 12/2017 Devos
2018/0010342 A1* 1/2018 Van Hooydonck ... E04F 15/105
2018/0094441 A1 4/2018 Boo
2018/0313093 A1 11/2018 Nilsson et al.
2019/0017278 A1 1/2019 De et al.
2019/0091977 A1 3/2019 Lundblad et al.
2019/0136545 A1 5/2019 De et al.
2019/0211569 A1 7/2019 Boo et al.
2019/0249444 A1 8/2019 Kell
2019/0277041 A1 9/2019 Pervan et al.
2019/0394314 A1 12/2019 Pervan et al.
2020/0056379 A1 2/2020 Boo
2020/0063441 A1 2/2020 Boo
2020/0180282 A1 6/2020 Lundblad et al.
2020/0208409 A1 7/2020 Kell
2020/0248462 A1 8/2020 Bergelin et al.
2020/0362567 A1 11/2020 Nilsson et al.
2020/0407981 A1 12/2020 Boo et al.
2021/0115680 A1 4/2021 Whispell et al.
2021/0207385 A1 7/2021 Boo
2021/0214953 A1 7/2021 Kell
2022/0112726 A1 4/2022 Bergelin et al.
2022/0341186 A1 10/2022 Nilsson et al.
2022/0341189 A1 10/2022 Whispell et al.

FOREIGN PATENT DOCUMENTS

CN 2106197 U 6/1992
CN 2124276 U 12/1992
CN 1270263 A 10/2000
CN 101492950 A 7/2009
DE 1081653 B 5/1960
DE 1198475 B 8/1965
DE 2251762 A1 5/1974
DE 2832817 A1 2/1980
DE 3538538 A1 5/1987
DE 3904686 C1 8/1989
DE 4020682 A1 1/1992
DE 4242530 A1 6/1994
DE 29517995 U1 2/1996
DE 19854475 A1 7/1999
DE 20002744 U1 8/2000
DE 20018817 U1 1/2001
DE 10001248 A1 7/2001
DE 10032204 C1 7/2001
DE 10006748 A1 8/2001
DE 20206460 U1 7/2002
DE 20207844 U1 8/2002
DE 10316695 A1 10/2004
DE 202005004537 U1 6/2005
DE 102005061099 A1 3/2007
DE 102006024184 A1 11/2007
DE 102006058655 A1 6/2008
DE 202008011589 U1 11/2008
DE 202008012001 U1 11/2008
DE 202004021867 U1 12/2011
DE 202016102034 U1 5/2016
EP 0665347 A1 8/1955
EP 0903451 A2 3/1999
EP 1045083 A1 10/2000
EP 1061201 A2 12/2000
EP 1165900 A1 1/2002
EP 1165906 A1 1/2002
EP 1262609 A1 12/2002
EP 1308577 A2 5/2003
EP 1350904 A2 10/2003
EP 1357239 A2 10/2003
EP 1362947 A2 11/2003
EP 1420125 A2 5/2004
EP 1570143 A1 9/2005
EP 1585875 A1 10/2005
EP 1938963 A1 7/2008
EP 2009197 A1 12/2008
EP 2339092 A1 6/2011
EP 2189591 A3 3/2012
EP 2516768 A2 10/2012
EP 2615221 A1 7/2013
FR 1293043 A 5/1962
FR 2810060 A1 12/2001
GB 1308011 A 2/1973
GB 1430423 A 3/1976
GB 1520964 A 8/1978
GB 2020998 A 11/1979
GB 2117813 A 10/1983
GB 2243381 A 10/1991
GB 2256023 A 11/1992

(56) References Cited

FOREIGN PATENT DOCUMENTS

| | | | |
|---|---|---|---|
| JP | 56-104936 | U | 8/1981 |
| JP | 56-131752 | A | 10/1981 |
| JP | 57-157636 | U | 10/1982 |
| JP | 59-185346 | U | 12/1984 |
| JP | 60-255843 | A | 12/1985 |
| JP | 01-178659 | A | 7/1989 |
| JP | 01-202403 | A | 8/1989 |
| JP | 01-033702 | Y2 | 10/1989 |
| JP | 05-096282 | U | 12/1993 |
| JP | 05-318674 | A | 12/1993 |
| JP | 06-039840 | B2 | 5/1994 |
| JP | 07-026467 | U | 5/1995 |
| JP | 07-180333 | A | 7/1995 |
| JP | 07-300979 | A | 11/1995 |
| JP | 08-074405 | A | 3/1996 |
| JP | 08-086080 | A | 4/1996 |
| JP | 08-109734 | A | 4/1996 |
| JP | 09-053319 | A | 2/1997 |
| JP | 10-002096 | A | 1/1998 |
| JP | 10-219975 | A | 8/1998 |
| JP | 11-131771 | A | 5/1999 |
| JP | 11-268010 | A | 10/1999 |
| JP | 2002-011708 | A | 1/2002 |
| JP | 3363976 | B2 | 1/2003 |
| KR | 10-1996-0005785 | A | 2/1996 |
| KR | 10-2007-0000322 | A | 1/2007 |
| KR | 10-2008-0096189 | A | 10/2008 |
| KR | 10-0870496 | B1 | 11/2008 |
| NO | 2013/151493 | A1 | 10/2013 |
| SE | 506254 | C2 | 11/1997 |
| SE | 0000785 | L | 9/2001 |
| SE | 0103130 | L | 3/2003 |
| WO | 89/03753 | A1 | 5/1989 |
| WO | 90/06232 | A1 | 6/1990 |
| WO | 94/01628 | A2 | 1/1994 |
| WO | 94/26999 | A1 | 11/1994 |
| WO | 96/27721 | A1 | 9/1996 |
| WO | 97/47834 | A1 | 12/1997 |
| WO | 98/38401 | A1 | 9/1998 |
| WO | 98/58142 | A1 | 12/1998 |
| WO | 99/17930 | A1 | 4/1999 |
| WO | 99/58254 | A1 | 11/1999 |
| WO | 99/66151 | A1 | 12/1999 |
| WO | 99/66152 | A1 | 12/1999 |
| WO | 00/07841 | A1 | 2/2000 |
| WO | 00/17467 | A1 | 3/2000 |
| WO | 00/22225 | A1 | 4/2000 |
| WO | 00/47841 | A1 | 8/2000 |
| WO | 00/52278 | A1 | 9/2000 |
| WO | 00/66856 | A1 | 11/2000 |
| WO | 01/02669 | A1 | 1/2001 |
| WO | 01/02670 | A1 | 1/2001 |
| WO | 01/02671 | A1 | 1/2001 |
| WO | 01/44669 | A2 | 6/2001 |
| WO | 01/47726 | A1 | 7/2001 |
| WO | 01/48331 | A1 | 7/2001 |
| WO | 01/48332 | A1 | 7/2001 |
| WO | 01/48333 | A1 | 7/2001 |
| WO | 01/51732 | A1 | 7/2001 |
| WO | 01/51733 | A1 | 7/2001 |
| WO | 01/53628 | A1 | 7/2001 |
| WO | 01/66877 | A1 | 9/2001 |
| WO | 01/75247 | A1 | 10/2001 |
| WO | 01/77461 | A1 | 10/2001 |
| WO | 01/88306 | A1 | 11/2001 |
| WO | 01/98604 | A1 | 12/2001 |
| WO | 02/55809 | A1 | 7/2002 |
| WO | 02/55810 | A1 | 7/2002 |
| WO | 02/60691 | A1 | 8/2002 |
| WO | 02/92342 | A1 | 11/2002 |
| WO | 2002/103135 | A1 | 12/2002 |
| WO | 03/12224 | A1 | 2/2003 |
| WO | 03/16654 | A1 | 2/2003 |
| WO | 03/25307 | A1 | 3/2003 |
| WO | 03/35396 | A1 | 5/2003 |
| WO | 03/44303 | A1 | 5/2003 |
| WO | 03/78761 | A1 | 9/2003 |
| WO | 03/83234 | A1 | 10/2003 |
| WO | 03/85222 | A1 | 10/2003 |
| WO | 03/89736 | A1 | 10/2003 |
| WO | 2004/005648 | A1 | 1/2004 |
| WO | 2004/011740 | A2 | 2/2004 |
| WO | 2004/016877 | A1 | 2/2004 |
| WO | 2004/044348 | A1 | 5/2004 |
| WO | 2004/050780 | A2 | 6/2004 |
| WO | 2004/052357 | A1 | 6/2004 |
| WO | 2004/053256 | A1 | 6/2004 |
| WO | 2004/053257 | A1 | 6/2004 |
| WO | 2004/085765 | A1 | 10/2004 |
| WO | 2005/068747 | A1 | 7/2005 |
| WO | 2005/088029 | A1 | 9/2005 |
| WO | 2005/098163 | A1 | 10/2005 |
| WO | 2006/032378 | A1 | 3/2006 |
| WO | 2006/043893 | A1 | 4/2006 |
| WO | 2006/104436 | A1 | 10/2006 |
| WO | 2006/123988 | A1 | 11/2006 |
| WO | 2006/133690 | A1 | 12/2006 |
| WO | 2007/015669 | A2 | 2/2007 |
| WO | 2007/016978 | A1 | 2/2007 |
| WO | 2007/020088 | A1 | 2/2007 |
| WO | 2007/053257 | A1 | 5/2007 |
| WO | 2007/079845 | A1 | 7/2007 |
| WO | 2007/081267 | A1 | 7/2007 |
| WO | 2007/118352 | A1 | 10/2007 |
| WO | 2008/008016 | A1 | 1/2008 |
| WO | 2008/008824 | A1 | 1/2008 |
| WO | 2008/068245 | A1 | 6/2008 |
| WO | 2008/116623 | A1 | 10/2008 |
| WO | 2008/133377 | A1 | 11/2008 |
| WO | 2008/142538 | A2 | 11/2008 |
| WO | 2009/061279 | A1 | 5/2009 |
| WO | 2009/071822 | A2 | 6/2009 |
| WO | 2010/012104 | A1 | 2/2010 |
| WO | 2010/015516 | A2 | 2/2010 |
| WO | 2010/023042 | A1 | 3/2010 |
| WO | 2010/028901 | A1 | 3/2010 |
| WO | 2010/072357 | A2 | 7/2010 |
| WO | 2010/081532 | A1 | 7/2010 |
| WO | 2010/086084 | A1 | 8/2010 |
| WO | 2010/114236 | A2 | 10/2010 |
| WO | 2010/128043 | A1 | 11/2010 |
| WO | 2011/012104 | A2 | 2/2011 |
| WO | 2011/028171 | A1 | 3/2011 |
| WO | 2011/032540 | A2 | 3/2011 |
| WO | 2011/038709 | A1 | 4/2011 |
| WO | 2011/077311 | A2 | 6/2011 |
| WO | 2011/138722 | A1 | 11/2011 |
| WO | 2012/069485 | A1 | 5/2012 |
| WO | 2012/084604 | A1 | 6/2012 |
| WO | 2012/101171 | A1 | 8/2012 |
| WO | 2012/126046 | A1 | 9/2012 |
| WO | 2012/136021 | A1 | 10/2012 |
| WO | 2013/017575 | A1 | 2/2013 |
| WO | 2013/026559 | A2 | 2/2013 |
| WO | 2013/044758 | A1 | 4/2013 |
| WO | 2013/092270 | A1 | 6/2013 |
| WO | 2014/007738 | A1 | 1/2014 |
| WO | 2014/043756 | A1 | 3/2014 |
| WO | 2014/182215 | A1 | 11/2014 |
| WO | 2014/209213 | A1 | 12/2014 |
| WO | 2015/078443 | A1 | 6/2015 |
| WO | 2015/104680 | A1 | 7/2015 |
| WO | 2015/174914 | A1 | 11/2015 |
| WO | 2016/029255 | A1 | 3/2016 |
| WO | 2017/101910 | A1 | 6/2017 |
| WO | 2017/115202 | A1 | 7/2017 |
| WO | 2017/187298 | A2 | 11/2017 |

OTHER PUBLICATIONS

Extended European Search Report dated Nov. 10, 2016 in EP 14 79 4996.0, European Patent Office, Munich, DE, 10 pages.

(56) References Cited

OTHER PUBLICATIONS

Extended European Search Report mailed in EP 18162875.1, dated Apr. 26, 2018, European Patent Office, Munich, DE, 13 pages.
Extended European Search Report mailed in EP 192062230, dated Feb. 10, 2020, European Patent Office, Munich, DE, 11 Pages.
International Search Report and accompanying Written Opinion issued in PCT/SE2014/050360, dated Jun. 3, 2014, ISA/SE Patent- och registreringsverket, Stockholm, SE, 12 pages.
Lowe's, How to Install a Laminate Floor, YouTube video available for viewing at https:/youtu.be/zhIXVHAejlk?t=3m52s, Oct. 2008 (last accessed Feb. 15, 2018).
Pervan, Darko (Author), Technical Disclosure entitled "VA073a Zip Loc," IP com No. IPCOM000210869D, Sep. 13, 2011, IP.com Prior Art Database, 36 pages.

* cited by examiner

KNOWN ART

FLOORBOARDS PROVIDED WITH A MECHANICAL LOCKING SYSTEM

CROSS REFERENCE TO RELATED APPLICATIONS

The present application is a continuation of U.S. application Ser. No. 17/067,989, filed on Oct. 12, 2020, which is a continuation of U.S. application Ser. No. 16/528,992, filed on Aug. 1, 2019, now U.S. Pat. No. 10,844,612, which is a continuation of U.S. application Ser. No. 15/333,630, filed on Oct. 25, 2016, now U.S. Pat. No. 10,407,919, which is a continuation of U.S. application Ser. No. 14/224,628, filed on Mar. 25, 2014, now U.S. Pat. No. 10,301,830, which claims the benefit of Swedish Application No. 1350377-6, filed on Mar. 25, 2013. The entire contents of U.S. application Ser. No. 17/067,989, U.S. application Ser. No. 16/528,992, U.S. application Ser. No. 15/333,630, U.S. application Ser. No. 14/224,628 and Swedish Application No. 1350377-6 are hereby incorporated herein by reference in their entirety.

TECHNICAL FIELD

The present disclosure relates to floorboards provided with a mechanical locking system, and a method for producing a mechanical locking system at edges of floorboards.

TECHNICAL BACKGROUND

Due to tolerances allowed during manufacturing, the thickness of different floorboards may slightly differ. As a consequence, different portions of a mechanical locking system may be arranged at different heights of the floorboards. For example, the distance from the sub floor on which the floorboards are arranged to a tongue arranged on a first floorboard may be different from the distance from the sub floor to a tongue groove of a second floorboard, into which the tongue is to be inserted for locking in a vertical direction, which is shown in FIG. 1. This may result in difficulties when joining the floorboards, since the floorboards may not enter into a locking position. However, such differences in thickness of the floorboards usually does not results in problems when locking the floorboards together when the floorboards are arranged on a foam provided on the sub-floor. Such a foam is usually compressible. The compressible foam allows a thicker floorboard to be pressed towards the sub-floor such that the tongue groove on the thicker floorboard is positioned at the same height as the tongue of an adjacent floorboard.

Such an underlying foam is conventionally used when installing laminate flooring, engineered wood floorings, etc. When installing floors made of plastics, such as vinyl floorings, for example LVT (Luxury Vinyl Tiles), such a foam is not conventionally used.

As a result, the differences in thickness between different floorboards may result in difficulties when locking the floorboards together, especially when joining the floorboards by a so-called fold down technique. The fold down technique involves assembling the floorboards by a vertical downward movement of one edge of one of the floorboards. As described above, floorboards having different thickness may result in the tongue groove of one floorboard being positioned at a different height than the tongue of the adjacent floorboard, resulting in difficulties when joining the floorboards, because the floorboards may not enter into a locking position.

SUMMARY

It is an object of at least certain embodiments of the present disclosure to provide an improvement over the above-described techniques and known art.

A further object of at least certain embodiments of the present disclosure is to facilitate locking of floorboards by means of a mechanical locking system.

Another object of at least certain embodiment of the present disclosure is to facilitate locking of floorboards by means of a mechanical locking system when the floorboards have different thicknesses.

A further object of at least certain embodiment of the present disclosure is to facilitate locking of floorboards by means of a mechanical locking system when no underlying foam is used.

At least some of these and other objects and advantages that will be apparent from the present disclosure have been achieved by floorboards provided with a mechanical locking system comprising a locking strip protruding from a first edge of a first floorboard, wherein the locking strip is provided with a locking element configured to cooperate with a locking groove at a lower side of a second edge of a second floorboard for locking the first and second edge in the horizontal direction. The first and the second edges are configured to be assembled by a vertical downward motion of the second edge towards the first edge. The second edge is provided with a calibrating groove adjacent the locking groove.

An advantage of embodiments of the present disclosure is that the calibrating groove compensates for floorboards having different thicknesses, especially a difference in thickness at the edges of the floorboards. The calibrating groove allows the second edge to be pushed towards a sub-floor on which the floorboards are arranged. Thereby, the second edge may be displaced such that an upper side of the second floorboard is aligned with an upper side of the first floorboard at the first and second edges, respectively, even if the thickness of the second floorboard exceeds the thickness of the first floorboard.

Another advantage of embodiments of the present disclosure is that locking of the floorboards may be facilitated. Conventionally, due to different floorboards having different thicknesses, locking of portions of the mechanical locking system such as a tongue and a tongue groove, may be hindered. The tongue may have difficulties in entering into engagement with the tongue groove for locking as discussed above. By providing the calibrating groove of the present disclosure, the second edge may be bent downwards until a locking position in which the tongue enters into the tongue groove is reached.

At least the second edge may be flexible.

At least the second floorboard may be flexible. The flexibility or resiliency of the second edge, or of the floorboard, allows the second edge to be bent downwards towards the sub-floor.

At least the second floorboard may comprise a plastic material, preferably a thermoplastic material, or an elastomer.

A core of the second floorboard may comprise a plastic material, preferably a thermoplastic material, or an elastomer.

The calibrating groove may be open towards the locking groove.

The depth of the calibrating groove may substantially equal or exceed a mean variation in thickness between the floorboards.

The depth of the calibrating groove may substantially equal a difference in thickness between the first and the second floorboard at the first and the second edge.

The calibrating groove may be arranged at the lower side of the second floorboard.

The locking element may comprise a curved outer upper part. The locking groove may have a shape complimentary to the shape of the locking element.

The first or the second edge may be provided with a tongue configured to cooperate with a tongue groove at the other of the first or the second edge for locking the first and the second edge in the vertical direction.

The tongue may be formed of the same material as the first or the second edge.

The tongue may be provided at the second edge and extend vertically downward from an upper side of the second floorboard.

The width of the tongue may increase with a distance from the upper side of the second floorboard.

The tongue may be a displaceable tongue arranged in a displacement groove. The displaceable tongue may be configured to enter into engagement with the tongue groove when the floorboards are in a locking position.

According to a second aspect, the present disclosure is realized by a method for producing a mechanical locking system at edges of a first and second floorboard. The method comprises the step of:

providing a first and a second floorboard, wherein the first floorboard has a first thickness and the second floorboard has a second thickness different from the first thickness, forming a locking groove at a lower side of a second edge of the first and second floorboard, and forming a calibrating groove at the lower side of the second edge of at least one of the first and second floorboard with a tool, wherein the tool is positioned at a fixed position relative an upper side of the first and second floorboard.

The method according to the second aspect of the present disclosure may incorporate the advantages of the floorboards, which have previously been discussed such that the previous discussion is applicable also to the method for producing a mechanical locking system.

The method may further comprise positioning a bottom surface of the calibrating groove at a fixed distance from the upper side of the first and second floorboard.

The bottom surface of the calibrating groove may positioned such that a depth of the calibrating groove substantially equals or exceeds a mean variation in thickness between the floorboards.

The bottom surface of the calibrating groove may be positioned such that a depth of the calibrating groove substantially equals a difference in thickness between the first and the second floorboard.

The locking groove and the calibrating groove may be formed adjacent each other. The calibrating groove may be formed in the lower side of the first floorboard and the second floorboard.

The calibrating groove may be open towards the locking groove.

The method may further comprise forming a locking strip provided with a locking element at a first edge of the first and the second floorboard, wherein the locking element is configured to cooperate with the locking groove. The locking element may be configured to cooperate with the locking groove for locking in a horizontal direction.

The method may further comprise forming a tongue groove at the first edge or the second edge of the first floorboard and the second floorboard, and providing a tongue at the other of the first edge and the second edge of the first floorboard and the second floorboard, wherein tongue is configured to cooperate with the tongue groove. The tongue may be configured to cooperate with the tongue groove for locking in a vertical direction.

The step of providing a tongue may comprise forming a displacement groove at the other of the first edge and the second edge of the first floorboard and the second floorboard, and inserting the tongue in the displacement groove, the tongue being displaceable in the displacement groove.

BRIEF DESCRIPTION OF THE DRAWINGS

The present disclosure will by way of example be described in more detail with reference to the attached drawings, which show embodiments of the present disclosure.

DETAILED DESCRIPTION

Figure 4:
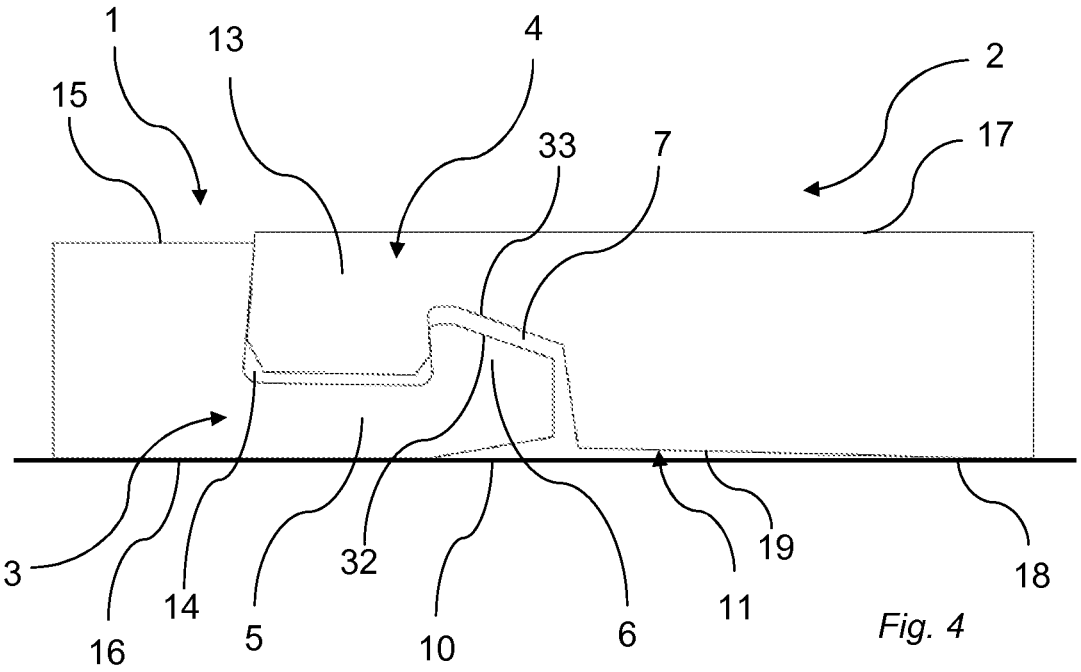
FIG. 4 shows floorboards according to another embodiment of the present disclosure.
Figure 5:
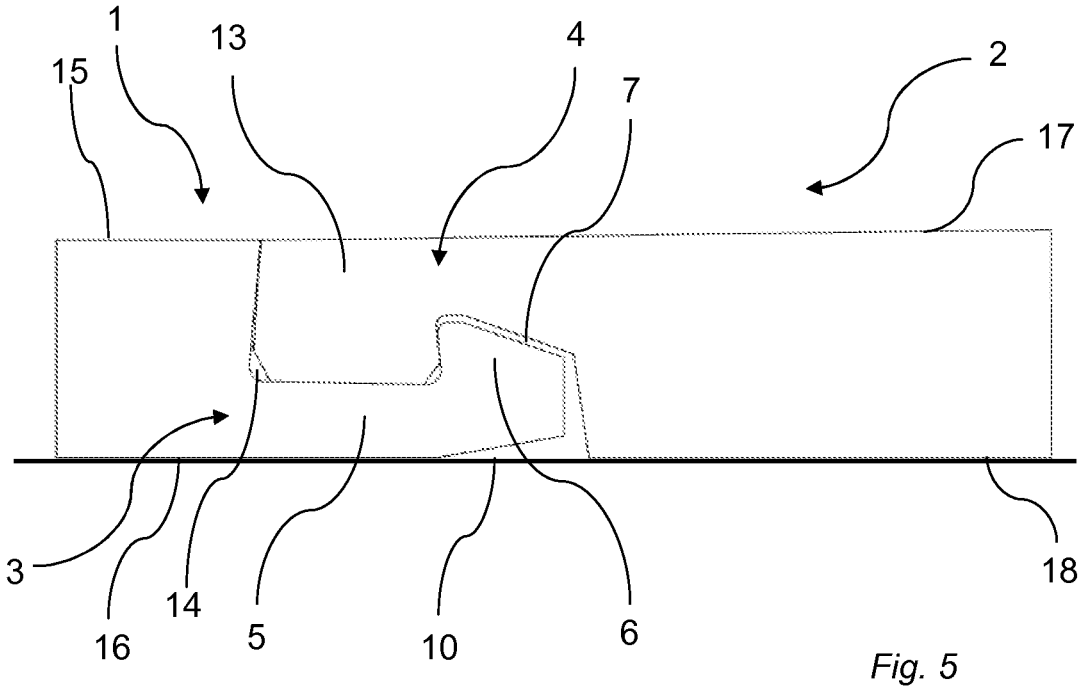
FIG. 5 shows the floorboards of FIG. 4 in a locked position.
Figure 6A:
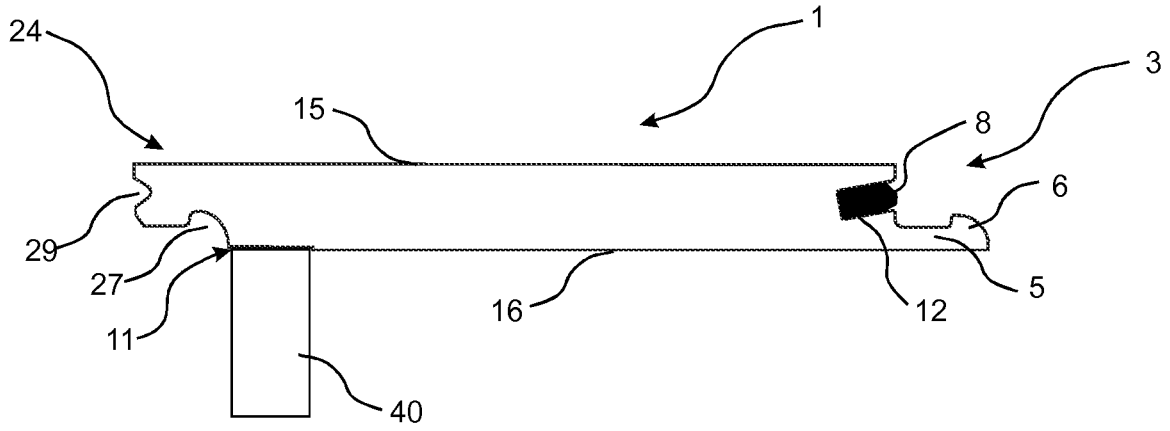
FIG. 6*a* shows a cross-section of a first floorboard.
Figure 6B:
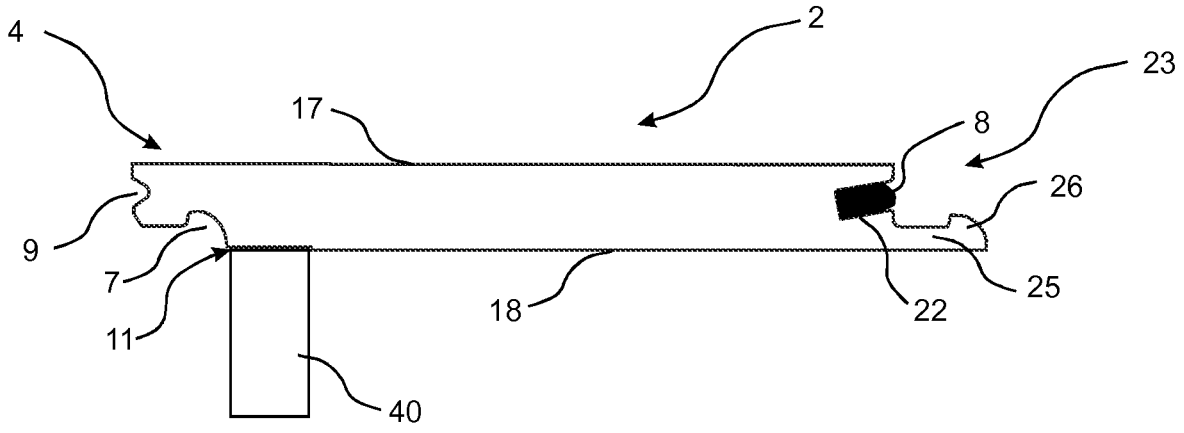
FIG. 6*b* shows a cross-section of a second floorboard.

FIGS. 2, 3, 4 and 5 show a mechanical locking system of a set of floorboards comprising at least a first floorboard 1 and a second floorboard 2. FIGS. 6*a* and 6*b* show the first floorboard 1 and the second floorboard 2, respectively. The first and second floorboards 1, 2 are arranged on a sub-floor 10. The first floorboard 1 has an upper side 15 facing away from the sub-floor 10 and a lower side 16 facing toward the sub-floor 10. The second floorboard 2 has an upper side 17 facing away from the sub-floor 10 and a lower side 18 facing toward the sub-floor 10.

The first and second floorboards 1, 2 are provided with the mechanical locking system. The mechanical locking system comprises a locking strip 5. The locking strip 5 protrudes from a first edge 3 of the first floorboard 1. The locking strip 5 is provided with a locking element 6. The locking element 6 is configured to cooperate with a locking groove 7 arranged at the lower side 18 of a second edge 4 of the second floorboard 2 for locking the first and second edges 3, 4 in a horizontal direction.

Figure 3:
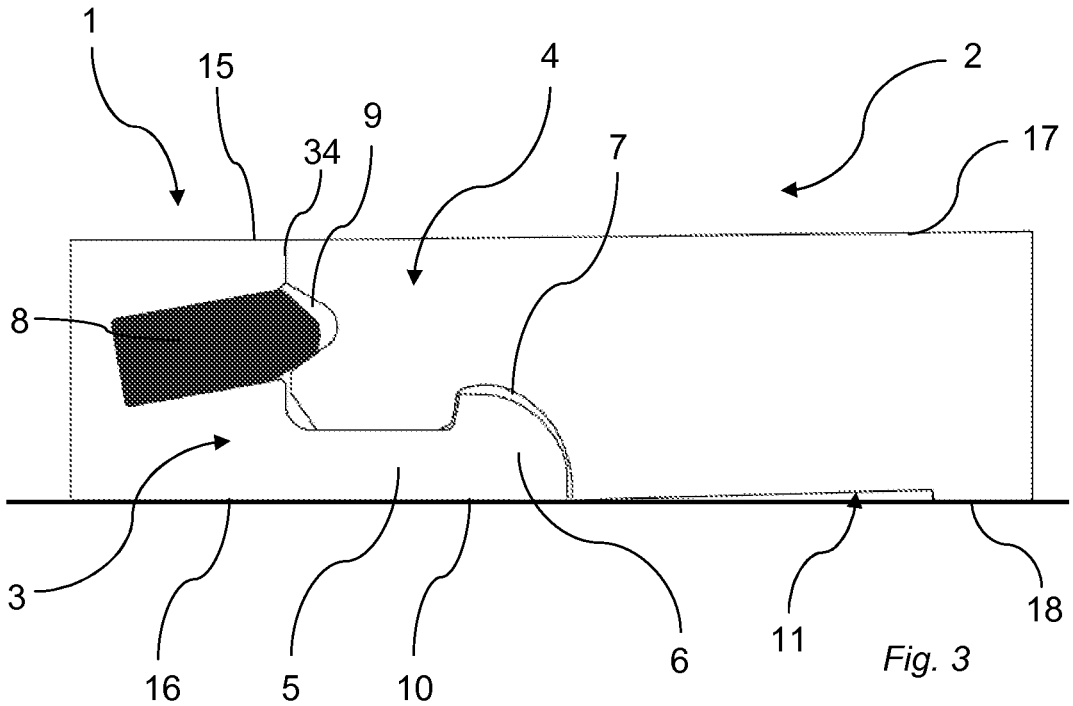
FIG. 3 shows the floorboards of FIG. 2 in a locked position.

The locking element 6 has an outer upper portion 30. The locking groove 7 has an outer lower portion 31. In the embodiment shown in FIGS. 2 and 3, the locking element 6 has a curved or rounded outer upper portion 30. The curved upper portion 30 may be shaped as a part of a circle or ellipse. The locking groove 7 may have a shape complimentary to the shape of the locking element 6. That is, the outer lower portion 31 of the locking groove 7 may be curved or rounded. In the embodiment shown in FIGS. 4 and 5, the locking element 6 has an inclined outer upper portion 32. The locking groove 7 may have a shape complimentary to the shape of the locking element 6. That is, the outer lower portion 33 of the locking groove 7 may be inclined. Further, a lower part of the locking element 6 facing the sub-floor 10 may be inclined relative to the sub-floor 10 as shown in FIGS. 4 and 5.

The first and second edges 3, 4 are configured to be assembled and locked together by a vertical downward motion of the second edge 4 towards the first edge 3.

Figure 1:
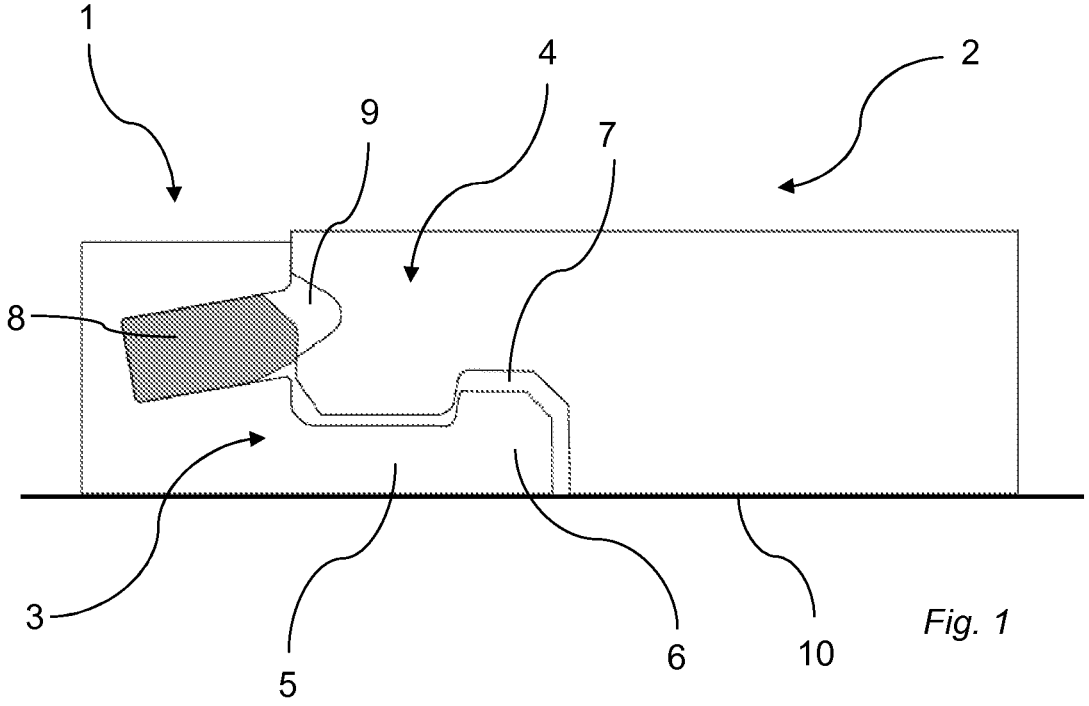
FIG. 1 shows floorboards arranged on sub-floor according to known art.
Figure 2:
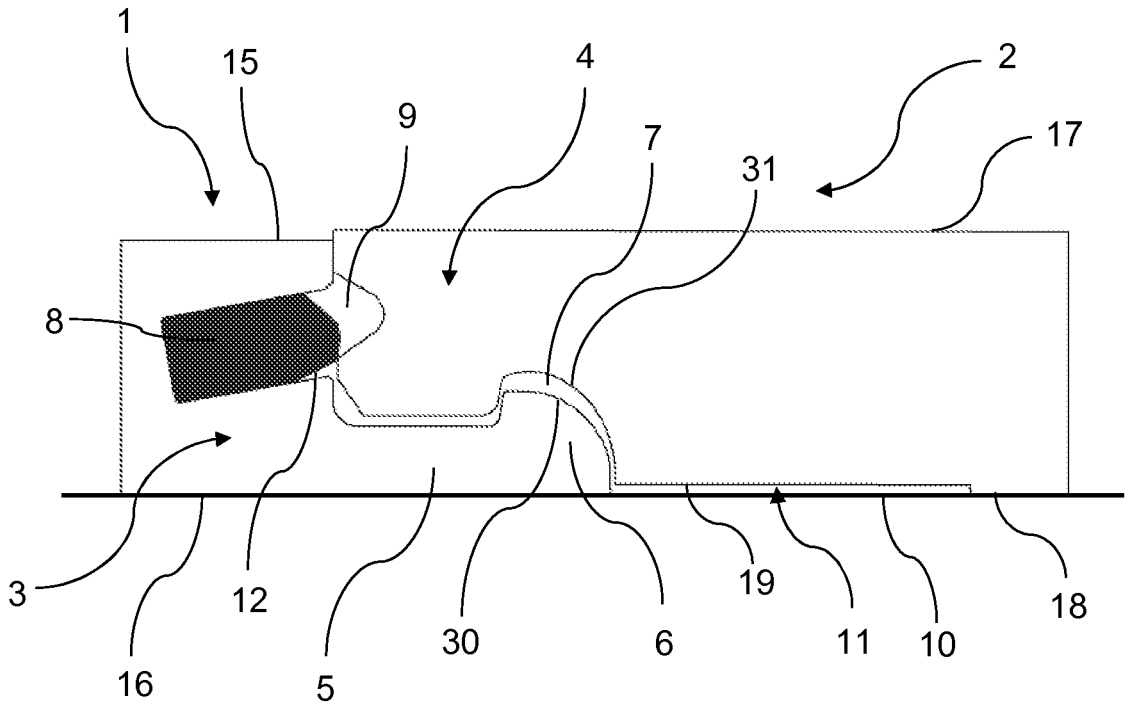
FIG. 2 shows floorboards according to an embodiment of the present disclosure.

The mechanical locking system may further comprise a tongue 8 and a tongue groove 9. The tongue 8 may be arranged at the first edge 3 or the second edge 4. The tongue groove 9 may be arranged at the other of the first edge 3 and the second edge 4. The tongue 8 is configured to cooperate with the tongue groove 9 for locking the first edge 3 and the second edge 4 in a vertical direction. The tongue 8 may protrude from the first edge 3 at an angle relative to the upper side 15 of the first floorboard 1 as shown in FIGS. 2 and 3. Alternatively, the tongue 8 may protrude from the first edge 3 in a horizontal direction with an angle.

As shown in FIGS. 2 and 3, the tongue 8 may be a displaceable tongue arranged in a displacement groove 12 at the first edge 3 or the second edge 4. The displaceable tongue 8 may be formed as a separate part. That is, the displaceable tongue 8 may be formed of a different material than the material of the first and second floorboards 1, 2. Such a displaceable tongue 8 is for example described in WO2007/015669. In the embodiment shown in FIGS. 2 and 3, the tongue 8 is a displaceable tongue arranged in a displacement groove 12 at the first edge 3. The tongue groove 9 is arranged at the second edge 4. The displaceable tongue 8 is displaceable within the displacement groove 12. The displaceable tongue 8 is configured to cooperate with the tongue groove 9 for locking the first edge 3 and the second edge 4 in a vertical direction.

In the embodiment shown in FIGS. 4 and 5, the tongue 13 may be formed of the same material as the first edge 3 or the second edge 4. The tongue 13 may be an integrated part of the first edge 3 or the second edge 4. In FIGS. 4 and 5, the tongue 13 is formed of the same material as the second edge 4. The tongue groove 14 is formed at the first edge 3. The tongue 13 is preferably configured to cooperate with the tongue groove 14 for locking the first edge 3 and the second edge 4 in a vertical direction. In the embodiment shown in FIGS. 4 and 5, the tongue 13 extends vertically downward from the upper side 17 of the second floorboard and protrudes horizontally. The width of the tongue 13 increases with the distance from the upper surface 17 of the second panel 2. The tongue 13 may have a dovetailed shape as seen in cross-section.

The first and second edges 3, 4 may be short edges of the first and second floorboards 1, 2, respectively. The long edges of the first and second floorboards 1, 2 may also be provided with a mechanical locking system. For example, the long edges may be provided with a mechanical locking system configured for locking floorboards together by angling. Alternatively, the long edges may be provided with a mechanical locking system of the type described above. It is also contemplated that the floorboards may be square shaped, rectangular shaped or any other polygonal shape.

In embodiments, at least the second edge 4 is flexible, elastic or resilient, such that the second edge 4 may be pushed in a vertical direction. The second edge 4 is preferably pushed downwards in the vertical direction towards the sub-floor 10. In one embodiment, the first and second floorboards 1, 2 are flexible, elastic, or resilient. The first and second floorboards 1, 2 may in this embodiment comprise a plastic material, preferably a thermoplastic material such as polyvinyl chloride (PVC), polyurethane (PU and/or PUR), polypropylene (PP), or polyethylene (PE), or a combination thereof. The thermoplastic material may be polystyrene (PS), polyethylene terephthalate (PET), polyacrylate, polyvinyl butyral, or a combination thereof. The first and second floorboards 1, 2 may also comprise an elastomer. The first and second floorboards 1, 2 may comprise a WPC (Wood Plastic Composite). The resiliency of the second edge 4 may also be obtained by removing material from the second edge 4.

In embodiments, the first and second floorboards 1, 2 may comprise one or more layers. The first and second floorboards 1, 2 may comprise a core. The mechanical locking system may be formed in the core. The first and second floorboards 1, 2 may further comprise a surface layer, preferably a decorative surface layer or a print layer arranged on an upper side of the core. The surface layer may further comprise a wear resistant layer arranged on the decorative surface layer or the print layer. The first and second floorboards 1, 2 may further comprise a backing layer arranged on a lower side of the core. The core may provide the second edge 4 flexible or resilient properties. The core may comprise a plastic material, preferably a thermoplastic material such as polyvinyl chloride (PVC), polyurethane (PU), polypropylene (PP), or polyethylene (PE)), or a combination thereof. The thermoplastic material may be polystyrene (PS), polyethylene terephthalate (PET), polyacrylate, polyvinyl butyral, or a combination thereof. The core may also comprise a WPC (Wood Plastic Composite). The core may also comprise an elastomer. It is also contemplated that the core may comprise more than one layer. For example, the core may comprise a first layer of a wood fibre based panel such as MDF or HDF and a second layer of a resilient material such as plastic, preferably comprising a thermoplastic material or an elastomer.

The first and second floorboards 1, 2 may be resilient floorboards such as Luxury Vinyl Tiles or Planks, vinyl free floorings, etc. The first and second floorboards 1, 2 may comprise a core, a surface layer arranged on an upper side of the core, and optionally a backing layer arranged on a lower side of the core. The core may comprise a thermoplastic material such as polyvinyl chloride (PVC), polyurethane (PU), polypropylene (PP), or polyethylene (PE). The core may comprise an elastomer. The surface layer may comprise one or more layers, such as a print layer, a wear resistant layer and a protective coating. The print layer and/or the wear resistant layer may comprise a thermoplastic material such as a thermoplastic foil. The thermoplastic material of the print layer and the wear resistant layer may be polyvinyl chloride (PVC), polyester, polypropylene (PP), polyethylene (PE), polystyrene (PS), polyurethane (PUR), polyethylene terephthalate (PET), polyacrylate, polyvinyl butyral, or a combination thereof. The protective coating may be a radiation curable coating such as UV curable coating.

As shown in FIGS. 2 and 3, and in FIGS. 4 and 5, the second edge 4 is provided with a calibrating groove 11. The calibrating groove 11 is arranged adjacent the locking groove 7. The calibrating groove 11 is arranged at a lower side 18 of the second floorboard 2. The calibrating groove 11 extends to the locking groove 7. The calibrating groove 11 is open towards the locking groove 7. The calibrating groove 11 extends from the lower side 18 of the floorboard 2 in a vertical direction. The calibrating groove 11 has a bottom surface 19, which may extend in a horizontal direction, or may be inclined.

In an embodiment in which the second floorboard 2 at the second edge 4 comprises a core, the calibrating groove 11 may be formed in the core. In an embodiment in which the second floorboard 2 at the second edge 4 comprises a core and a backing layer at the lower side of the core, the calibrating groove 11 may formed in the backing layer, or in the backing layer and the core.

The calibrating groove 11 is configured to adjust to differences in thickness between the first and second floorboards 1, 2, and especially configured to adjust to a difference in thickness at the first and second edges 3, 4 of the first and second floorboards 1, 2, respectively. As seen in FIGS. 2 and 4, the thickness of the second floorboard 2 at the second edge 4 exceeds the thickness of the first floorboard 1 at the first edge 3. As a consequence, the tongue groove 9 is arranged above the tongue 8 such that the tongue 8 is hindered from entering into cooperation with the tongue groove 9, as shown in FIG. 2. In the embodiment shown in FIG. 4, the tongue 13 is only partly inserted into the tongue groove 14. The locking surfaces of the tongue 13 and tongue groove 14 are only partly in engagement.

When arranged on the sub-floor 10, the presence of the calibrating groove 11 at the second edge 4 results in a distance being formed between the sub-floor 10 and the floorboard 2 at the second edge 4. The calibrating groove 11 allows that the second edge 4 to be pushed towards the sub-floor 10 to a position wherein the tongue 8, 13 can enter into engagement with the tongue groove 9, 14, which is shown in FIGS. 3 and 5. When the tongue 8, 13 engages with the tongue groove 9, 14, the first edge 3 and the second edge 4 are locked in the vertical direction. As seen in FIGS. 3 and 5, at least a portion of a bottom surface 19 of the calibrating groove 11 is abutting the sub-floor 10. The engagement of the tongue 8, 13 in the tongue groove 9, 14 locks the first edge 3 and the second edge 4 in a position wherein the second edge 4 is bent towards the sub-floor 10. Preferably, the upper side 17 of the second floorboard 2 at the second edge 4 is aligned with the upper side 15 of the first floorboard 1 at the first edge 3 when the tongue 8, 13 has entered into engagement with the tongue groove 9.

Preferably, the flexible or resilient properties of the second floorboard 2, or of the core of the second floorboard 2, help achieve the desired bending at the second edge 4. The width of the calibrating groove 11 in a horizontal direction parallel to the upper surface 17 and perpendicular to a joint plane 34 may be adjusted to material properties of the second floorboard 2. If the second floorboard 2 is more rigid, the width of the calibrating groove 11 should be increased in order to obtain the desired bending at the second edge 4. If the second floorboard 2 is more flexible and/or resilient, the width of the calibrating groove 11 can be reduced compared to the more rigid floorboard. By adjusting the width of the calibrating groove 11, the desired flexibility and resiliency of the second floorboard 2 for allowing bending of the second edge 4 towards the sub-floor 10 can be achieved.

The calibrating groove 11 preferably extends along the extension of the second edge 4 in a horizontal direction parallel to the upper surface 17 and horizontally along the joint plane 34. The calibrating groove 11 is preferably continuous. In an alternative embodiment, the calibrating groove 11 may be non-continuous in the horizontal direction parallel to the upper surface 17 and horizontally along the joint plane 34.

Preferably, the depth of the calibrating groove 11 substantially equals the difference in thickness between the first floorboard 1 and the second floorboard 2. Preferably, the depth of the calibrating groove 11 is less than 0.5 mm, preferably less than 0.3 mm, more preferably less than 0.2 mm.

The calibrating groove 11 can be formed when forming the mechanical locking system. The depth of the calibrating groove 11 can be chosen as a mean difference in thickness between several floorboards, or as a depth exceeding the mean difference in thickness between several floorboards. Floorboards having a thickness exceeding a desired thickness may be provided with a calibrating groove 11. Floorboards having a thickness less than the desired thickness may not be provided with any calibrating groove 11.

FIG. 6*a* shows the first floorboard 1 in cross-section. The first floorboard 1 comprises the first edge 3 and a second edge 24. FIG. 6*b* shows the second floorboard 2 in cross-section. The second floorboard 2 comprises the second edge 4 and a first edge 23. The first and second floorboards 1, 2 in FIGS. 6*a*-6*b* correspond to the first and second floorboards 1, 2 in FIGS. 2-5 described above. FIGS. 2-5 show joining of the first and second floorboards 1, 2 while FIGS. 6*a*-6*b* show the floorboards separately. The description of the first and second floorboards 1, 2 with reference to FIGS. 2-5 above is applicable also for the first and second floorboards 1, 2 described below with reference to FIGS. 6*a*-6*b*, and vice versa.

A method of forming a mechanical locking system at edges of the first and second floorboards 1, 2 will now be described with reference to FIGS. 6*a*-6*b*. A locking groove 27 is formed at a lower side 16 of the second edge 24 of the first floorboard 1 having a first thickness. A locking groove 7 is also formed at a lower side 18 of the second edge 4 of the second floorboard 2 having a second thickness. The thickness of the first floorboard 1 may differ from the thickness of the second floorboard 2.

If the thickness of any one of the first and second floorboards 1, 2, preferably measured at the second edge 4, 24 where the locking groove 7, 27 is formed, exceeds a predetermined thickness, a calibrating groove 11 is formed in that floorboard. If the thickness is equal to or less than a predetermined thickness, no calibrating groove is formed. In FIGS. 6*a*-6*b*, a calibrating groove 11 has been formed in both the first and second floorboards 1, 2.

The calibrating groove 11 is formed by a tool 40. The tool 40 is positioned at a fixed distance from an upper side 15, 17 of the first floorboard 1 and the second floorboard 2. The fixed distance is the same between the upper side 15 of the first floorboard 1 and the tool 40 and between the upper side 17 of the second floorboard 2 and the tool 40. The fixed distance corresponds to a predetermined desired value of the thickness. The predetermined desired value may correspond to a mean thickness of at least the first and second floorboards.

By the tool 40 being arranged at a fixed position, any floorboard having a thickness exceeding said distance will be provided with a calibrating groove 11. The tool 40 may be a knife, a heating device adapted to melt a portion of the floorboard, a scraping tool, a carving tool, etc.

The first floorboard 1 and the second floorboard 2 are preferably conveyed by the same conveyor element when the floorboards 1, 2 pass the tool 40. The distance between the conveyor element and the tool 40 is fixed. Preferably, the upper side 15, 17 of the first floorboard 1 and the second floorboard 2, respectively, abut the conveyor element.

The calibrating groove 11 is formed at the lower side 16, 18 of the second edge 4, 24 of the first and second floorboards 1, 2. The calibrating groove 11 may be formed by cutting, scraping, or melting a portion of the floorboard. The calibrating groove 11 is formed such that the calibrating groove 11 is open towards the locking groove 7, 27. The calibrating groove 11 is arranged adjacent the locking groove 7, 27. Preferably, the first and second floorboards 1, 2 are conveyed in a horizontal direction between a first position wherein the locking groove 7, 27 is formed and a second position wherein the calibrating groove 11 is formed.

The calibrating groove 11 has a bottom surface 19. The calibrating groove 11 is formed such that the bottom surface 19 of the calibrating groove 11 of a first floorboard 1 and the bottom surface 19 of the calibrating groove 11 of a second floorboard 2 are positioned at substantially the same distance from the upper side 15, 17 of the first and second floorboards 1, 2, respectively. A distance between the upper side 15, 17 of a respective floorboard and the bottom surface 19 of each calibrating groove 11 is essentially the same for the first and second floorboards 1, 2. Even if the first and second floorboards 1, 2 have a different thickness, the bottom surface 19 of each calibrating groove 11 is positioned at a substantially equal distance from the upper side 15, 17 of the respective first and second floorboards 1, 2. Consequently, the depth of the calibrating groove 11 may differ from one floorboard to another depending on the original thickness of the floorboard at the second edge 4, 24.

The method may further comprise forming a locking strip 5 provided with a locking element 6 at the first edge 3 of the first floorboard 1 and forming a locking strip 25 provided with a locking element 26 at the first edge 23 of the second floorboard 2. The locking element 6, 26 is configured to cooperate with the locking groove 7, 27 for locking in a horizontal direction.

The method may further comprise forming a tongue groove 9 at the second edge 4 of the second floorboard 2 and forming a tongue groove 29 at the second edge 24 of the first floorboard 1. A displacement groove 12 may be formed at the first edge 3 of the first floorboard 1 and a displacement groove 22 is formed at the first edge 23 of the second floorboard 2. The method may further comprise inserting a displaceable tongue 8 into each displacement groove 12 and 22 as shown in FIGS. 6*a*-6*b*. The displaceable tongue 8 is displaceable within the displacement groove 12, 22. The displaceable tongue 8 is adapted to lock the floorboards in the vertical direction. Alternatively, vertical locking may be obtained by the tongue 13 and the tongue groove 14 shown in FIGS. 4 and 5.

It is to be understood that the locking strip 25, the locking element 26 and the displacement groove 22 of the first edge 23 of the second floorboard 2 essentially correspond to the locking strip 5, the locking element 6 and the displacement groove 12 of the first edge 3 of the first floorboard 1, and that the description above with reference to FIGS. 2-5 also is applicable to FIGS. 6*a*-6*b*.

It is to be understood that locking groove 27 and the tongue groove 29 of the second edge 24 of the first floorboard 1 essentially correspond to the locking groove 7 and the tongue groove 9 of the second edge 4 of the second floorboard 2, and that the description above with reference to FIGS. 2-5 also is applicable to FIGS. 6*a*-6*b*.

The first and second edges 3, 4, 23, 24 may be short edges of the first and second floorboards 1, 2. The long edges of the first and second floorboards 1, 2 may be provided with a mechanical locking system. For example, the long edges may be provided with a mechanical locking system configured for locking floorboards together by angling. Alternatively, the long edges may be provided with a mechanical locking system of the type described above. It is also contemplated that the floorboards may be square shaped, rectangular shaped or any other shape. It is contemplated that there are numerous modifications of the embodiments described herein, which are still within the scope of the present disclosure.

By upper side 15, 17 of the floorboards 1, 2 is meant a side facing away from the sub-floor 10 when the floorboards are installed. However, during production, the upper surface 15, 17 may not necessary facing upwards but may temporarily facing downwards. It is further contemplated that the calibrating groove 11 may have any shape. For example, the calibrating groove may be U-shaped as shown in FIGS. 2-3. Furthermore, the bottom surface 19 of the calibrating groove 11 may be inclined, as shown in FIGS. 4-5.

Furthermore, it is contemplated that the mechanical locking system described above with reference to FIGS. 2-6*b* may be used without the calibrating groove 11. For example, floorboards having a mechanical locking system may be provided, comprising a locking strip 5 protruding from a first edge 3 of a first floorboard 1. The locking strip 5 may be provided with a locking element 6 configured to cooperate with a locking groove 7 at a lower side 18 of a second edge 4 of a second floorboard 2 for locking the first edge 3 and the second edge 4 in the horizontal direction. The locking element 6 comprises a curved outer upper part 30. The locking groove 7 may have a curved outer lower part 31.

The invention claimed is:

1. Floorboards including a mechanical locking system, the mechanical locking system comprising a locking strip protruding from a first edge of a first floorboard, wherein the locking strip includes a locking element configured to cooperate with a locking groove at a lower side of a second edge of a second floorboard for locking the first edge and the second edge in a horizontal direction, wherein the first edge or the second edge includes a tongue configured to cooperate with a tongue groove at the other of the first edge or the second edge for locking of the first edge and the second edge in a vertical direction, wherein the first edge and the second edge are configured to be assembled by a vertical downward motion of the second edge towards the first edge, wherein a core of the first floorboard comprises a plastic material and a core of the second floorboard comprises a plastic, wherein at least said second edge is flexible, wherein said second edge includes a calibrating groove adjacent said locking groove, wherein the calibrating groove is open towards the locking groove, and wherein the calibrating groove is configured such that the second edge is bendable downwards until a locking position in which the tongue enters into the tongue groove is reached.

2. The floorboards as claimed in claim 1, wherein the calibrating groove is arranged at the lower side of the second edge of the second floorboard.

3. The floorboards as claimed in claim 1, wherein the locking element has a curved outer upper part.

4. The floorboards as claimed in claim 1, wherein the tongue is formed of the same material as the first edge or the second edge.

5. The floorboards as claimed in claim 1, wherein the tongue is provided at the second edge and extends vertically downward from an upper side of the second floorboard.

6. The floorboards as claimed in claim 1, wherein a width of the tongue increases with a distance from the upper side of the second floorboard.

7. The floorboards as claimed in claim 1, wherein the tongue is a displaceable tongue arranged in a displacement groove.

8. The floorboards as claimed in claim 1, wherein the locking groove opens downward.

9. The floorboards as claimed in claim 1, wherein the locking element protrudes upward.

10. The floorboards as claimed in claim 1, wherein the calibrating groove connects with the locking groove at a bottom surface of the second floorboard.

11. Floorboards including a mechanical locking system, the mechanical locking system comprising a locking strip protruding from a first edge of a first floorboard, wherein the locking strip includes a locking element configured to cooperate with a locking groove at a lower side of a second edge of a second floorboard for locking the first edge and the second edge in a horizontal direction, wherein the first edge or the second edge includes a tongue configured to cooperate with a tongue groove at the other of the first edge or the second edge for locking of the first edge and the second edge in a vertical direction, wherein the first edge and the second edge are configured to be assembled by a vertical downward motion of the second edge towards the first edge, wherein a core of the first floorboard comprises a plastic material and a core of the second floorboard comprises a plastic, wherein at least said second edge is flexible, wherein said second edge includes a calibrating groove adjacent said locking groove, wherein the calibrating groove is open towards the locking groove, and wherein the calibrating groove being adapted to allow the second edge to be pushed towards a sub-floor on which the floorboards are adapted to be arranged to a position wherein the tongue can enter into engagement with the tongue groove.

12. The floorboards as claimed in claim 11, wherein the calibrating groove is arranged at the lower side of the second edge of the second floorboard.

13. The floorboards as claimed in claim 11, wherein the locking element has a curved outer upper part.

14. The floorboards as claimed in claim 11, wherein the tongue is formed of the same material as the first edge or the second edge.

15. The floorboards as claimed in claim 11, wherein the tongue is provided at the second edge and extends vertically downward from an upper side of the second floorboard.

16. The floorboards as claimed in claim 11, wherein a width of the tongue increases with a distance from the upper side of the second floorboard.

17. The floorboards as claimed in claim 11, wherein the tongue is a displaceable tongue arranged in a displacement groove.

18. The floorboards as claimed in claim 11, wherein the locking groove opens downward.

19. The floorboards as claimed in claim 11, wherein the locking element protrudes upward.

20. The floorboards as claimed in claim 11, wherein the calibrating groove connects with the locking groove at a bottom surface of the second floorboard.

* * * * *